US005265831A

United States Patent [19]

Muller

[11] Patent Number: 5,265,831

[45] Date of Patent: Nov. 30, 1993

[54] ARRANGEMENT FOR DETECTING AN OBJECT BY MEANS OF SOUND CONDUCTED THROUGH A SOLID BODY AND METHOD OF USING SUCH ARRANGEMENT

[76] Inventor: Bruno Muller, Stettfurt, Switzerland

[21] Appl. No.: 752,578

[22] PCT Filed: Jan. 31, 1991

[86] PCT No.: PCT/CH91/00001

§ 371 Date: Sep. 9, 1991

§ 102(e) Date: Sep. 9, 1991

[87] PCT Pub. No.: WO91/10584

PCT Pub. Date: Jul. 25, 1991

[30] Foreign Application Priority Data

Jan. 12, 1990 [CH] Switzerland ..... 96/90-2

[51] Int. Cl.[5] ..... B61L 1/06; B61L 25/02

[52] U.S. Cl. ..... 246/124; 246/169 S; 246/270 R; 73/636

[58] Field of Search ..... 246/124, 167 A, 122 R, 246/125, 29 R, 169 S, 270 R, 292, DIG. 1; 73/636, 662; 324/207.15, 256, 257, 260; 340/425.3

[56] References Cited

U.S. PATENT DOCUMENTS

| | | | |
|---|---|---|---|
| 1,748,965 | 3/1930 | Watson | 246/169 S |
| 1,788,182 | 1/1931 | Zierdt | 246/169 S |
| 1,834,077 | 12/1931 | Sorensen | 246/169 S |
| 1,864,016 | 6/1932 | Gherassimoff | 246/169 S |
| 2,011,658 | 8/1935 | Sorensen | 246/169 S |
| 2,346,748 | 4/1944 | Grondahl et al. | 246/124 |
| 2,592,163 | 4/1952 | Madden | 246/169 S |
| 3,978,447 | 8/1976 | Bankes | 246/29 R X |
| 4,167,877 | 9/1979 | Avery | 73/662 X |
| 4,290,058 | 9/1981 | Bystricky . | |
| 4,887,032 | 12/1989 | Hetrick | 324/256 X |
| 4,932,618 | 6/1990 | Davenport et al. | 246/122 R |

FOREIGN PATENT DOCUMENTS

| | | | |
|---|---|---|---|
| 0024978 | 3/1981 | European Pat. Off. . | |
| 802209 | 8/1936 | France | 246/169 S |
| 643078 | 5/1984 | Switzerland . | |
| 1066867 | 1/1984 | U.S.S.R. . | |
| 1066868 | 1/1984 | U.S.S.R. . | |
| 1175778 | 8/1985 | U.S.S.R. | 246/124 |
| 21895 | of 1903 | United Kingdom | 246/169 S |

OTHER PUBLICATIONS

Copy of International Search Report and Annex.

*Primary Examiner*—Michael S. Huppert
*Assistant Examiner*—Scott L. Lowe
*Attorney, Agent, or Firm*—Sandler, Greenblum & Bernstein

[57] ABSTRACT

A method and apparatus for detecting an impact sound, such as a sound caused by a railroad vehicle approaching a construction location. The apparatus comprises an arrangement for detecting impact sound or vibrations with a receiver mounted at the rail, for example, and, further, an evaluation circuit for processing the vibrations and triggering a warning signal when the intensity of the receiver-output signal continuously increases, for example, when the intensity in a predetermined frequency range passes through predetermined threshold values during predetermined times. Thus, an approaching railroad vehicle can be positively detected by monitoring a continuously increasing sound or vibration which is propagated in the rails.

28 Claims, 1 Drawing Sheet

ARRANGEMENT FOR DETECTING AN OBJECT BY MEANS OF SOUND CONDUCTED THROUGH A SOLID BODY AND METHOD OF USING SUCH ARRANGEMENT

BACKGROUND OF THE INVENTION

1. Field of the Invention

The invention relates to an arrangement for detecting an object containing an impact sound-receiver for detection of impact sound produced by the object and transmitted in a sound-conducting medium to the receiver, and containing an evaluation circuit which receives an output signal from the receiver and delivers a warning signal when this output signal fulfills predetermined criteria, as well as to the use of this arrangement, especially for determining an approaching train.

2. Description of the Related Art

Such an arrangement is known, for example, from Swiss Patent No. 643,078. It serves for detecting an intruder during an attempt to break through a wall or a safe door in that there are detected impact sound-vibrations transmitted through the brickwork, wall or door serving as sound-conducting medium to the impact sound-receiver and processed by the evaluation circuit. With this arrangement, the signal evaluation is accomplished such that there are reliably distinguished the vibrations arising during an intrusion attempt from spurious vibrations emanating from the surroundings and there is avoided giving of a false alarm signal. In this regard it is attempted to suppress the delivery of a signal for such length of time until it is ensured that the received impact sound really has been caused by an intrusion attempt.

For other uses where, for example, an object which generates an impact sound with continuously increasing or decreasing intensity, must be indicated in all events, and a short-time faulty signal output caused by possible spurious vibrations can be absolutely tolerated, the aforementioned known arrangements are only suitable to a limited extent. In those situations, there was previously preferred purely human monitoring which is frequently unreliable and oftentimes resulted in serious accidents.

SUMMARY OF THE INVENTION

The invention is concerned with the object of further developing the aforementioned arrangements for detecting an object by means of impact sound produced by the object in such a manner that there can be positively signalled in any event also an object with continuously increasing or decreasing intensity of the generated impact sound and also in the presence of other spurious vibrations.

According to the invention this object is achieved in that the evaluation circuit is constructed to deliver a signal to a warning device when the output signal of the impact sound-receiver within a predetermined time exhibits a predetermined change in intensity, for example, when the intensity exceeds a predetermined threshold value between two points in time.

It is advantageous when the evaluation circuit periodically checks the intensity at uniform time intervals by means of a comparator and triggers a warning signal in the event that between at least two successive points in time the intensity has exceeded a threshold value, and if the warning signal is maintained for such length of time until the intensity between two later measuring time points has again fallen beneath a predetermined threshold value.

It is particularly advantageous if there are provided a plurality of threshold values, and a warning signal is then triggered when the intensity of the impact sound has passed through both of the threshold values within a specific frequency range during predetermined time intervals, something which is an unmistakable sign of an object having continuously increasing intensity of the generated impact sound.

Such an arrangement can be used to advantage, for instance, for the detection of an approaching vehicle. It is particularly suitable for the detection of a track-bound vehicle, for instance a railroad train or a locomotive upon a track, in order, for example, to warn track maintenance workers of an approaching train or to close and again open at the proper time a barrier at a railroad crossing. The impact sound-receivers are mounted at the rails and record the impact sound generated by the train and transmitted through the rails to the measuring site, the intensity of which continuously increases during the approach of the train. The special signal evaluation ensures that with the greatest probability a warning signal is triggered also in the presence of spurious signals, but, however, there is nonetheless ensured for a certain selectivity, so that with enhanced security there can be prevented the occurrence of an accident having, as a general rule, catastrophic consequences, in contrast to reliance upon frequently unreliable human observation, especially in the presence of unfavorable weather conditions, such as fog, or during fatigue or other faulty behavior of the monitoring personnel.

BRIEF DESCRIPTION OF THE DRAWINGS

The invention will be more fully explained based upon the accompanying FIGURES. There is shown in.

DETAILED DESCRIPTION OF THE INVENTION

Figure 1:
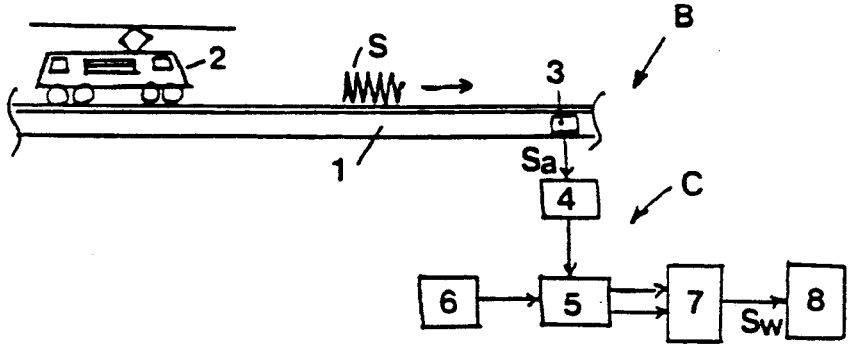
FIG. 1 an embodiment of an arrangement for signalling an approaching train at a remotely located rail construction site with an associated evaluation circuit in schematic illustration, FIG. 2 a function diagram for the signal evaluation for delivering a warning signal, and FIG. 3 a function diagram for a different signal evaluation circuit.

In FIG. 1 there is depicted an arrangement for detecting an object in the form of a train 2 which, upon a track 1, approaches a track construction site B. The train 2 or the locomotive produces in the rails I a characteristic impact sound-noise which is further transmitted by means of the rails serving as sound-conducting medium at the speed of sound, that is, at several km/sec. from the train 2 to the construction site B. At that location there is secured at one or both rails an impact sound-receiver 3, that is to say, mounted in good sound-conducting contact. It is advantageous to provide an acoustic receiver comprising a piezo-electric acoustic/electrical transducer, or an impact sound-receiver of an other known construction. This receiver 3 delivers an electric output signal which is delivered to a signal evaluation circuit C.

The evaluation circuit C is provided at its input with a frequency element or filter 4 having a frequency throughpass range which is accommodated to the frequency spectrum of a travelling train and is preferably selected in the kHz-range. As a result, there is reliably detected the noise produced in the rails by a train, wherein, however, there are eliminated spurious noises of other frequencies, for instance, low-frequency ground vibrations and eliminated from the evaluation.

It is advantageous to acoustically insulate from the surroundings the frequency element 4, in order to suppress the transmission of spurious noises through the air.

The output signal is then delivered to a time discriminator 5 which is controlled by a clock generator 6. The time discriminator produces two output signals for the intensity of the received impact sound in the selected frequency range at two different points in time. Both of these two mutually time-shifted signals arrive at the inputs of a comparator 7 which continuously compares at any given time the intensities of two successive signal intensities and delivers a signal to a warning device 8 as soon as both intensities differ by a predetermined amount. In this regard, such may be concerned with the triggering or switching-in of a warning signal for the construction crew if the intensity, during the approach of a train, has increased by a certain amount, or the re-setting or turning-off of the warning signal upon decrease of the intensity for an away-moving train.

Figure 2:
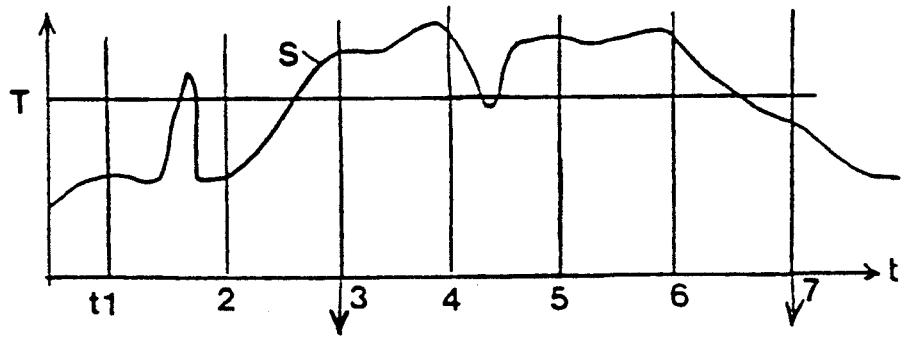

FIG. 2 shows an example of a function schematic of the evaluation circuit C. The curve depicts the timewise course of the intensity I of the output signal of the receiver 3 in the selected frequency range. The comparator 7 of the evaluation circuit compares the intensity during respective successive times t1, t2, t3 . . . and so forth, and, in particular, determines if at two points in time there has been exceeded a predetermined threshold value T. In the illustrated embodiment, there is indeed briefly exceeded the threshold value T between the measuring times t1 and t2, for example, due to a brief event like an impact at the rails, however, the intensity during both measuring times is below the threshold value, so that in this case there is not triggered a warning signal. However, between the measuring times t2 and t3 the intensity gradually increases and between t2 and t3 passes through the threshold value T. In this case, a warning signal is thus triggered at t3, which signals an approaching train. The warning signal is maintained during such time as the intensity, during the following measuring times, remains above the threshold T, also if, as depicted between t4 and t5, it should briefly drop below the threshold T. The warning signal is re-set only when the intensity gradually decreases, as depicted between t6 and t7, as an indication that the train has again moved away.

Figure 3:
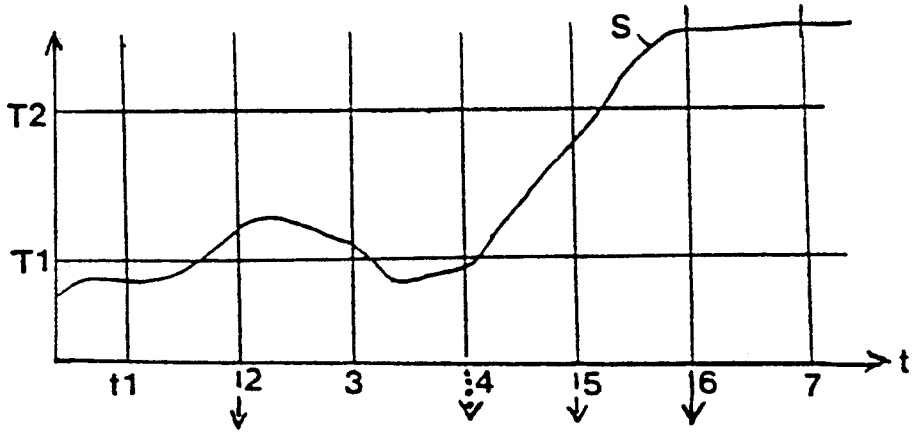

FIG. 3 depicts on the basis of an analog function schematic an advantageous further development of the invention. Here, there are provided two staggered threshold values T1 and T2 for the intensity I. No reaction takes place as long as the intensity remains beneath the lower threshold T1. If at two measuring times t1 and t2 there is exceeded the lower threshold T1, then initially there is triggered a pre-warning signal, for example, there is activated a warning device and rendered operationally ready. Upon dropping of the intensity beneath the threshold T1 at time t4, the pre-warning signal is re-set until, for instance, at time t5 it is again activated due to repeatedly exceeding the threshold. If there then occurs a further increase of the intensity beyond the upper threshold T2, for example, at measuring time t6, then at this point in time there is triggered the main warning signal, and thus, there is signalled the approach of a train.

It is possible to construct differently the evaluation circuit C within the framework of the inventive concept. In order to fulfill its function it must be constructed to signal within a predetermined time interval a predetermined increase (or decrease) of the output signal of the impact sound-receiver. The evaluation also can be advantageously accomplished with a microprocessor. Instead of undertaking the evaluation digitally it also can be accomplished in analog manner. For example, the discriminator 5, upon exceeding a lower threshold T1, can activate a timing switch which, after expiration of a predetermined delay time, causes the discriminator to check whether the signal at this point in time has exceeded the upper threshold T2, or has exceeded this threshold T2 within a predetermined time window.

It is also advantageous to provide at both rails of a track a respective impact sound-receiver, and the signal of both receivers is processed in a gate circuit, preferably with an OR-gate, so that in any event there is delivered a signal when one of the receivers, for some reason, should not deliver a signal, or, however, with an AND-gate, in order to eliminate disturbances due to random noise vibrations in only one rail.

It is remarked that the invention also can be used for detecting other objects provided that such produce impact noise with continuously increasing intensity at a remotely situated measuring site, for example, for signalling the approach of road vehicles, for instance, caterpillar vehicles at a certain location by detecting the ground vibrations and for triggering appropriate measures.

I claim:

1. An arrangement for detecting an object, said arrangement comprising:

a vibration receiver for detecting vibrations produced by the object;

an evaluation circuit for receiving an output signal from said vibration receiver and for delivering a warning signal in response to said output signal from said vibration receiver fulfilling predetermined criteria, said evaluation circuit comprising a comparator, said comparator comprising:

means for comparing intensity of said output signal received from said vibration receiver during at least two different points in time; and means for delivering a warning signal to a warning device in response to an occurrence of said output signal intensity above a predetermined threshold value at two different points in time;

said evaluation circuit further comprising:

means for determining said intensity of said output signal at uniform time intervals and means for maintaining said warning signal until said output signal fails to be above said predetermined threshold at at least one of said points in time;

said predetermined threshold comprising a predetermined higher threshold; and said evaluation circuit further comprising means for triggering a pre-warning signal in response to an occurrence of said output signal, between a first and a second point in time, above a predetermined lower threshold, whereby said means for delivering a warning signal delivers said warning signal in response to an occurrence of said output signal intensity above said predetermined higher threshold value at a further point in time.

2. An arrangement for detecting an object according to claim 1, in combination with a warning device.

3. An arrangement for detecting an object according to claim 1, wherein:

said further point in time is a third point in time and wherein said first, second, and third points in time are consecutive points in time measured by said evaluation circuit.

4. An arrangement for detecting an object according to claim 1, wherein:

said evaluation circuit further comprises a frequency filter for receiving said output signal from said vibration receiver, said frequency filter having a throughpass range corresponding to a frequency range of vibrations to be detected.

5. An arrangement for detecting an object according to claim 1, wherein:

said vibration receiver comprises a piezo-electric acoustic electrical transducer.

6. An arrangement for detecting an object according to claim 1, wherein:

said means for delivering a warning signal to a warning device delivers said warning signal in response to an occurrence of said output signal intensity above a predetermined threshold value as identified by said means for comparing at two successive points in time.

7. An arrangement for detecting an object according to claim 1, further comprising:

a sound conducting medium for conducting vibrations to said vibration receiver.

8. An arrangement for detecting an object according to claim 7, said sound conducting medium comprises at least one rail along which a vehicle is guided for movement.

9. An arrangement for detecting an object according to claim 7, wherein:

said sound conducting medium comprises a plurality of rails along which a vehicle is guided for movement, said vibration receiver comprising a first vibration receiver provided at a first of said plurality of rails, said arrangement further comprising:

a second vibration receiver provided at a second of said plurality of rails; and a gate circuit connected to each of said first vibration receiver and said second vibration receiver.

10. An arrangement for detecting an object, said arrangement comprising:

a vibration receiver for detecting vibrations produced by the object;

an evaluation circuit for receiving an output signal from said vibration receiver and for delivering a warning signal in response to said output signal from said vibration receiver fulfilling predetermined criteria, said evaluation circuit comprising a comparator, said comparator comprising:

means for comparing intensity of said output signal received from said vibration receiver during at least two different points in time; and means for delivering a warning signal to a warning device in response to an occurrence of said output signal intensity above a predetermined threshold value at two different points in time;

said evaluation circuit further comprising:

means for determining said intensity of said output signal at uniform time intervals and means for maintaining said warning signal until said output signal fails to be above said predetermined threshold at at least one of said points in time;

said predetermined threshold comprising a predetermined higher threshold; and said evaluation circuit further comprising means for triggering a pre-warning signal in response to an occurrence of said output signal, between a first and a second point in time, above a predetermined lower threshold, whereby said means for delivering a warning signal further comprises means for delivering said warning signal in response to an occurrence of said output signal intensity above said predetermined higher threshold value at two further points in time.

11. An arrangement for detecting an object according to claim 10, wherein:

said means for delivering a warning signal to a warning device delivers said warning signal in response to an occurrence of said output signal intensity above a predetermined threshold value as identified by said means for comparing at two successive points in time.

12. An arrangement for detecting an object according to claim 10, in combination with a warning device.

13. An arrangement for detecting an object according to claim 10, wherein:

said evaluation circuit further comprises a frequency filter for receiving said output signal from said vibration receiver, said frequency filter having a throughpass range corresponding to a frequency range of vibrations to be detected.

14. An arrangement for detecting an object according to claim 10, wherein:

said vibration receiver comprises a piezo-electric acoustic electrical transducer.

15. An arrangement for detecting an object according to claim 10, further comprising:

a sound conducting medium for conducting vibrations to said vibration receiver.

16. An arrangement for detecting an object according to claim 15, wherein said sound conducting medium comprises at least one rail along which a vehicle is guided for movement.

17. An arrangement for detecting an object said arrangement comprising:

a vibration receiver for detecting vibrations produced by the object;

an evaluation circuit for receiving an output signal from said vibration receiver and for delivering a warning signal in response to said output signal from said vibration receiver fulfilling predetermined criteria, said evaluation circuit comprising a comparator, said comparator comprising:

means for comparing intensity of said output signal received from said vibration receiver during at least two different points in time;

means for delivering a warning signal to a warning device in response to an occurrence of said output signal intensity above a predetermined threshold value as identified by said means for comparing at two successive points in time;

a sound conducting medium for conducting vibrations to said vibration receiver, wherein said sound-conducting medium comprises a plurality of rails along which a vehicle is guided for movement, said vibration receiver comprising a first vibration receiver provided at a first of said plurality of rails;

a second vibration receiver provided at a second of said plurality of rails; and a gate circuit connected to each of said first vibration receiver and said second vibration receiver;

wherein said gate circuit comprises an AND-gate and wherein said means for delivering a warning signal to a warning device delivers said warning signal, by means of said AND-gate, only in response to an occurrence of an output signal intensity above a predetermined threshold value at two successive points in time with respect to both said first of said plurality of rails and said second of said plurality of rails.

18. A method of detecting an object, said method comprising the steps of:

receiving vibrations produced by the object at a plurality of different points in time;

generating an output signal as a function of said vibrations received from said object;

generating a warning signal in response to an occurrence of said output signal having an intensity above a predetermined threshold value at two different points in time;

producing a warning in response to the generation of said warning signal; and maintaining said warning signal until said output signal fails to be above said predetermined threshold at at least one of said points in time;

wherein said predetermined threshold comprises a predetermined higher threshold, said method further comprising triggering a pre-warning signal in response to an occurrence of said output signal, between a first and a second point in time, above a predetermined lower threshold, whereby said step of generating a warning signal further comprises generating said warning signal in response to an occurrence of said output signal intensity above said predetermined higher threshold value at a further point in time.

19. A method of detecting an object according to claim 18, wherein:

said further point in time is a third point in time and wherein said first, second, and third points in time are consecutive points in time measured by said evaluation circuit.

20. A method of detecting an object according to claim 18, wherein:

said step of generating a warning signal comprises the step of generating a warning signal in response to an occurrence of said output signal having an intensity above a predetermined threshold value at two successive points in time of said plurality of different points in time.

21. A method of detecting an object according to claim 18, wherein:

said method comprises a method of detecting an approaching rail-guided vehicle, wherein said step of receiving vibrations comprises receiving vibrations transmitted by at least one rail of said rail-guided vehicle.

22. A method of detecting an object according to claim 21, wherein:

said step of receiving vibrations comprises receiving vibrations transmitted by a plurality of rails of said rail-guided vehicle, and wherein said step of generating a warning signal comprises generating a warning signal in response to an occurrence of said output signal having an intensity above a predetermined threshold value at two different points in time at either of two of said plurality of rails.

23. A method of detecting an object according to claim 21, wherein:

said step of receiving vibrations comprises receiving vibrations transmitted by a plurality of rails of said rail-guided vehicle, and wherein said step of generating a warning signal comprises generating a warning signal in response to an occurrence of said output signal having an intensity above a predetermined threshold value at two different points in time at at least two of said plurality of rails.

24. A method of detecting an object, said method comprising the steps of:

receiving vibrations produced by the object at a plurality of different points in time;

generating an output signal as a function of said vibrations received from said object;

generating a warning signal in response to an occurrence of said output signal having an intensity above a predetermined threshold value at two different points in time;

producing a warning in response to the generation of said warning signal; and maintaining said warning signal until said output signal fails to be above said predetermined threshold at at least one of said points in time;

wherein said predetermined threshold comprises a predetermined higher threshold, said method further comprising triggering a pre-warning signal in response to an occurrence of said output signal, between a first and a second point in time, above a predetermined lower threshold, whereby said step of generating a warning signal further comprises generating said warning signal in response to an occurrence of said output signal intensity above said predetermined higher threshold value at two further points in time.

25. A method of detecting an object according to claim 24, wherein:

said step of generating a warning signal comprises the step of generating a warning signal in response to an occurrence of said output signal having an intensity above a predetermined threshold value at two successive points in time of said plurality of different points in time.

26. A method of detecting an object according to claim 24, wherein:

said method comprises a method of detecting an approaching rail-guided vehicle, wherein said step of receiving vibrations comprises receiving vibrations transmitted by at least one rail of said rail-guided vehicle.

27. A method of detecting an object according to claim 26, wherein:

said step of receiving vibrations comprises receiving vibrations transmitted by a plurality of rails of said rail-guided vehicle, and wherein said step of generating a warning signal comprises generating a warning signal in response to an occurrence of said output signal having an intensity above a predetermined threshold value at two different points in time at either of two of said plurality of rails.

28. A method of detecting an object according to claim 26, wherein:

said step of receiving vibrations comprises receiving vibrations transmitted by a plurality of rails of said rail-guided vehicle, and wherein said step of generating a warning signal comprises generating a warning signal in response to an occurrence of said output signal having an intensity above a predetermined threshold value at two different points in time at at least two of said plurality of rails.

* * * * *